US005848350A

United States Patent [19]

Bulger

[11] Patent Number: 5,848,350

[45] Date of Patent: Dec. 8, 1998

[54] NICKEL-FREE STAINLESS STEEL ALLOY PROCESSIBLE THROUGH METAL INJECTION MOLDING TECHNIQUES TO PRODUCE ARTICLES INTENDED FOR USE IN CONTACT WITH THE HUMAN BODY

[75] Inventor: Matthew K. Bulger, Port Orange, Fla.

[73] Assignee: FloMet, Inc., DeLand, Fla.

[21] Appl. No.: 962,055

[22] Filed: Oct. 31, 1997

[51] Int. Cl.[6] ..... B22F 1/00

[52] U.S. Cl. ..... 419/36; 419/38

[58] Field of Search ..... 419/38, 36; 75/243, 75/246; 420/37

[56] References Cited

U.S. PATENT DOCUMENTS

| | | | |
|---|---|---|---|
| 4,668,290 | 5/1987 | Wang et al. | 75/235 |
| 4,815,975 | 3/1989 | Garrel et al. | 433/189 |
| 5,501,834 | 3/1996 | Nakasuji et al. | 420/36 |
| 5,682,665 | 11/1997 | Svanberg | 29/458 |

OTHER PUBLICATIONS

"Metal Injection Molding Of Nickel–Free Stainless Steels", by Peter J. Uggowitzer, Wolf–Friedrich Baehre and Markus O. Speidel, delivered on Jul. 1, 1997 to a powder metal conference in Chicago, Ill.

*Primary Examiner*—Ngoclan Mai
*Attorney, Agent, or Firm*—Jack Schuman

[57] ABSTRACT

A nickel-free stainless steel having the following composition in weight percent:

| | |
|---|---|
| Chromium | 23–27 |
| Molybdenum | 2–7 |
| Carbon | 0.2 maximum |
| Iron | balance |
| plus incidental impurities | |

is made into a fine powder. Alternatively, the powder may be made by mixing powders of the pure elements or master alloys (e.g., pure chromium, iron-chromium, etc.) in the disclosed proportions. The metal powder is combined with a plasticizer to form a mixture when is then subjected to metal injection molding techniques to form an article which, after sintering and secondary operations, can be used in contact with the human body.

1 Claim, No Drawings

NICKEL-FREE STAINLESS STEEL ALLOY PROCESSIBLE THROUGH METAL INJECTION MOLDING TECHNIQUES TO PRODUCE ARTICLES INTENDED FOR USE IN CONTACT WITH THE HUMAN BODY

BACKGROUND OF THE INVENTION

1. Field of the Invention

This invention pertains to a nickel-free stainless steel alloy which, in the form of a powder, is mixed with a plasticizer or binder, the resulting mixture, through application of conventional metal injection molding techniques, being injection molded to form desired articles of various shapes for use in contact with the human body.

This invention also pertains to the article, produced by the foregoing metal injection molding techniques (MIM) applied to a particular nickel-free stainless steel alloy, which article is intended for use in contact with the human body.

2. Description of the Prior Art

It is now recognized that nickel-containing stainless steel alloys conventionally used to form articles intended to be in contact with the human body (e.g., implants, dental items, etc.) are capable of causing allergic reactions (such as swelling, reddening, exzema, itching, etc.) caused by perspiration, saliva and other bodily fluids leaching nickel from such nickel-containing articles.

This phenomenon has become a serious medical problem. In fact, legislation has been introduced in several European countries designed to regulate human exposure to nickel leached from articles fabricated from nickel-containing stainless steels and used in contact with the human body.

This problem is addressed in a paper entitled "Metal Injection Molding Of Nickel-Free Stainless Steels", prepared by Peter J. Uggowitzer, Wolf-Friedrich Baehre and Markus O. Speidel, and delivered on Jul. 1, 1997 at a powder metal conference in Chicago, Ill. As a solution to the problem of nickel sensitivity, the authors proposed a nickel-free austenitic stainless steel having the following composition in weight percent:

| | |
|---|---|
| Chromium | 16.5–17.5 |
| Molybdenum | 3.0–3.5 |
| Manganese | 10–12 |
| Nitrogen | 0.8–1.2 |

The authors state that nitrogen fully replaces nickel in conventional stainless steel compositions, and thus it appears that nitrogen is an essential element of the alloy which is the subject of this paper. The authors further state that, because the solubility of nitrogen in the liquid alloy is far below the threshold needed for a fully austenitic structure, the gas-atomized MIM powder is low in nitrogen and therefore ferritic, and consequently the necessary amount of nitrogen is added through solid state nitriding during or after the sintering phase. It is believed that addition of the necessary nitrogen during or after the sintering phase constitutes an additional step requiring additional equipment and increasing the cost of production.

Other nickel-free stainless steel compositions are known, but they are low in corrosion resistance. For example, an alloy of the following composition by weight:

| | |
|---|---|
| Chromium | 23–27 |
| Iron | balance |

was prepared under the direction of the present inventor and, when tested, showed unacceptable corrosion resistance in the mouth, thus rendering this composition unsuited for dental applications, at least.

Biocompatible nickel-free corrosion resistant alloys containing titanium are known, but these are difficult to process through MIM techniques.

The present invention provides an eminently satisfactory solution to the problem of nickel sensitivity with respect to stainless steel articles intended for use in contact with the human body.

SUMMARY OF THE INVENTION

One of the objects of this invention is to provide a biocompatible nickel free stainless steel composition which can readily be processed by means of metal injection molding techniques (MIM) to form articles for use in contact with the human body, thereby to prevent allergic reactions of the human body which otherwise would be experienced when the human body is in contact with nickel-containing stainless steels.

Another of the objects of this invention is to provide an article formed by subjecting a nickel-free stainless steel composition to MIM techniques, which article can safely be used in contact with the human body, thereby eliminating any possibility of a nickel-sensitivity reaction of the human body.

Other and further objects of this invention will become apparent by reference to the accompanying specification and to the appended claims.

The foregoing objects are attained by providing a nickel-free stainless steel alloy of the composition hereinafter disclosed, and subjecting said alloy to metal injection molding techniques to form the article intended for use in contact with the human body.

DESCRIPTION OF THE PREFERRED EMBODIMENT

An alloy of the following composition by weight percent:

| | |
|---|---|
| Chromium | 23–27 |
| Molybdenum | 2–7 |
| Carbon | 0.2 maximum |
| Iron | balance |
| plus incidental impurities | |

is prepared and is converted into a fine powder by means of conventional techniques such as, but not limited to, gas atomization or water atomization. The particle size of the resulting metal powder should be such as is typically used in MIM processing (for example, 20 microns or less). Alternatively, the powder can be blended from elemental or master alloys (e.g., pure chromium, iron-chromium, etc.), in the form of powders, to the composition disclosed herein.

The metal powder having the composition disclosed herein is then mixed with a conventional plasticizer (also known as a binder) to form a mixture which can be injection molded using conventional MIM techniques.

After the mixture of metal powder and plasticizer has been injection molded into the desired shape, which can be complex in geometry, the plasticizer is removed by any one of a number of well-known debinding techniques available to the metal powder injection molding industry such as, but not limited to, solvent extraction, thermal, catalytic or wicking.

Subsequently, the formed article from which the plasticizer or binder has been removed is densified in a sintering step in any one of a number of furnace types such as, but not limited to, batch vacuum, continuous atmosphere or batch atmosphere.

The sintering step densifies the article to a final porosity of 8% or less. This makes the remaining pores in the article discontinuous, and thereby increases the corrosion resistance of the article.

The sintering step also decreases the level of carbon in the article, and this is beneficial.

Secondary operations may take place at any stage of the process, often after sintering, and may for example include straightening, bending, burr removal, polishing, heat treating, machining, etc.

The article resulting from processing the nickel-free stainless steel composition hereinabove disclosed by means of MIM techniques exhibits several significant advantages over articles made from nickel-containing stainless steels or other alloy compositions of the prior art, viz:

(1) The article made according to the present invention avoids allergic reaction of the human body to nickel.

(2) The article made according to the present invention is readily formed, even with a complex geometry, under MIM techniques.

(3) The article made according to the present invention shows excellent corrosion resistance when in contact with body fluids (such as perspiration, saliva, etc.).

Because the nickel-free stainless steel composition hereinabove disclosed is fully compatible with the MIM process, the full advantage of MIM can be obtained, including:

(1) The molded article has a high density.

(2) The molded article has good mechanical properties.

(3) In multiple production of articles, excellent reproducibility of geometry, even complex geometry, is realized.

(4) Substantial cost savings in the production of articles of intricate profile are realized.

Since modifications and changes which do not depart from the spirit of the invention as disclosed herein may occur to those skilled in the art to which this invention pertains, the appended claims should be contrued as covering modifications and equivalents suitable to the practice of the invention.

I claim:

1. The method of making a biocompatible nickel-free article for use in contact with the human body, said method comprising the following steps:

(a) preparing a nickel-free metal powder consisting essentially of the following composition in weight percent:

| | |
|---|---|
| Chromium | 23–27 |
| Molybdenum | 2–7 |
| Carbon | 0.2 maximum |
| Iron | balance |
| plus incidental impurities, | |

(b) compounding said metal powder with a plasticizer to form an injection-moldable mixture, (c) injection molding said mixture of metal powder and plasticizer to form said article, (d) removing the plasticizer from said formed article, (e) sintering said formed article.

* * * * *